US005558107A

United States Patent [19]

Kim

[11] Patent Number: 5,558,107

[45] Date of Patent: Sep. 24, 1996

[54] HAIR CURLER ESPECIALLY FOR COLD WAVING

[75] Inventor: Hyeong S. (Motin) Kim, Kowloon, Hong Kong

[73] Assignee: Georg Wiegner, Kowloon, Hong Kong

[21] Appl. No.: 261,258

[22] Filed: Jun. 17, 1994

[30] Foreign Application Priority Data

Jun. 24, 1993 [DE] Germany ..... 43 20 972.6

[51] Int. Cl.[6] ..... A45D 6/06

[52] U.S. Cl. ..... 132/228; 132/250

[58] Field of Search ..... 132/227, 228, 132/232, 268, 250, 255, 256

[56] References Cited

U.S. PATENT DOCUMENTS

| | | | |
|---|---|---|---|
| Re. 27,033 | 1/1971 | Mitsumoto . | |
| T871,005 | 7/1969 | Freeman . | |
| 1,718,025 | 6/1929 | Bishinger . | |
| 1,994,099 | 3/1935 | Fulton . | |
| 2,166,386 | 7/1939 | Auster . | |
| 2,171,885 | 9/1939 | Michael . | |
| 2,331,065 | 10/1943 | Willat . | |
| 2,404,517 | 7/1946 | Molchan | 132/228 |
| 2,631,593 | 3/1953 | Madore . | |
| 2,708,941 | 5/1955 | Field | 132/255 |
| 2,747,585 | 5/1956 | Allen, Jr. . | |
| 2,825,344 | 3/1958 | Lenois | 132/250 |
| 2,838,053 | 6/1958 | Zimmerman | 132/250 |
| 2,874,706 | 2/1959 | Ficicchy | 132/250 |
| 2,941,534 | 6/1960 | Otto et al. | 132/250 |
| 2,972,994 | 2/1961 | Ferens . | |
| 3,045,685 | 7/1962 | Cormier | 132/250 |
| 3,105,502 | 10/1963 | Mitchell . | |
| 3,106,213 | 10/1963 | Clare . | |
| 3,123,080 | 3/1964 | Albertoni . | |
| 3,204,646 | 9/1965 | Chamberlin . | |
| 3,326,222 | 6/1967 | Rosenheim . | |
| 3,388,709 | 6/1968 | Morris . | |
| 3,530,863 | 9/1970 | Foster . | |
| 3,666,915 | 5/1972 | De Napoli | 219/222 |
| 3,700,853 | 10/1972 | Jensen | 219/222 |
| 3,759,271 | 9/1973 | Caruso . | |
| 3,812,866 | 5/1974 | Morane | 132/255 |
| 3,882,500 | 5/1975 | Shinbashi . | |
| 3,923,068 | 12/1975 | Gilman | 132/250 |
| 3,943,946 | 3/1976 | Gallegos . | |
| 4,298,787 | 11/1981 | Barradas | 219/222 |
| 4,431,012 | 2/1984 | Albertoni . | |
| 4,465,084 | 8/1984 | Fulgoni . | |
| 4,516,011 | 5/1985 | Jeffres | 219/222 |

(List continued on next page.)

FOREIGN PATENT DOCUMENTS

| | | |
|---|---|---|
| 0197208 | 10/1986 | European Pat. Off. . |
| 0460452A1 | 12/1991 | European Pat. Off. . |
| 1247508 | 11/1959 | France . |
| 1404587 | 5/1964 | France . |
| 2382212 | 2/1978 | France . |
| 2503996 | 10/1981 | France . |
| 2615079 | 5/1987 | France . |
| 1793426 | 2/1959 | Germany . |
| 1851705 | 11/1961 | Germany . |
| 1457375 | 3/1965 | Germany . |
| 426125 | 12/1966 | Germany . |
| 1557333 | 1/1972 | Germany . |
| 2338330 | 2/1975 | Germany . |
| 7505892 | 10/1975 | Germany . |
| 2426028 | 12/1975 | Germany . |
| 2622364 | 12/1976 | Germany . |
| 2002226 | 2/1979 | Germany . |
| 3005837 | 9/1980 | Germany . |
| 3230357 | 2/1984 | Germany . |
| 3309241 | 9/1984 | Germany . |
| 3616076A1 | 11/1987 | Germany . |
| 2192786 | 1/1988 | United Kingdom . |
| 88/00445 | 1/1988 | WIPO . |

*Primary Examiner*—Todd E. Manahan

*Attorney, Agent, or Firm*—Steven F. Caserza; Flehr, Hohbach, Test, Albritton & Herbert

[57] ABSTRACT

A hair roller or curler, especially for permanent waving, e.g. cold waving, which has between larger diameter end members, a tubular grid upon which the hair is wound and through which a treating liquid can be forced downwardly.

12 Claims, 3 Drawing Sheets

U.S. PATENT DOCUMENTS

| | | | |
|---|---|---|---|
| 4,638,821 | 1/1987 | Smith . | |
| 4,687,010 | 8/1987 | Caruso . | |
| 4,699,159 | 10/1987 | Thaler . | |
| 4,771,797 | 9/1988 | Kosaka | 132/272 |
| 4,989,621 | 2/1991 | Keller . | |
| 5,007,443 | 4/1991 | Fulgoni . | |
| 5,117,090 | 5/1992 | Askins . | |
| 5,144,968 | 9/1992 | Rivera . | |
| 5,255,694 | 10/1993 | Caruso | 132/211 |
| 5,263,501 | 11/1993 | Maznik | 132/211 |
| 5,286,949 | 2/1994 | Simons | 219/222 |
| 5,309,930 | 5/1994 | Presser | 132/272 |

HAIR CURLER ESPECIALLY FOR COLD WAVING

FIELD OF THE INVENTION

My present invention relates to a hair curler for cold waving of the type which comprises a hollow cylindrical curler body upon which a lock of hair can be wound and generally of a reduced diameter, and means or devices on the ends of that body for engagement by a clamping band or stirrup for retaining the wound lock on that body.

BACKGROUND OF THE INVENTION

Basically there are two types of hair curlers. Hair curlers of a first type are intended to form relatively short-lived curls of moist or dry hair and hair curlers of a second type for producing long-lived curls with the aid of chemical treatments. Both types of hair curlers differ with respect to their diameters. Hair curlers are provided with diameters of 13 mm to 80 mm for the first type of curling.

By contrast, cold waving hair curlers have diameters beginning at 4 mm and have a maximum diameter, with respect to the part of the curler about which the lock of hair is wound, of about 15 mm.

Cold waving is carried out with the aid of chemical treatment of the hair resulting in a more or less permanent or residual structural change therein. The chemical processes involved are complex since they may include a softening of the hair substance with the aid of waving agents and a fixing of the deformed structure with fixing agents. If the wetting of the hair with the waving agent is incomplete, the results are poor.

If the following fixing step is incomplete, the results can be catastrophic, including a total or partial dissolution of the hair substance, the loss of all or part of the hair, etc. The hair curler, therefore, is of considerable importance in hair dressing since it must be complete to ensure full treatment of the hair wound in multiple layers upon the curler, i.e. treatment of those layers which lie closest to the curler body as well as those layers of the lock of hair which may be exposed once the lock is wound on the curler.

The waving and fixing liquids must be capable of penetrating from the upper or outermost layers to the innermost layers and, of course depending upon the length of the hair and the number of turns of the lock on the curler, this has been difficult to ensure with conventional curlers. A further problem with respect to most earlier curlers is that the penetration of the liquid into and through the hair wound on the curler is often impeded by the impenetrability of the body of the curler.

The cost of a cold wave and the time consumed in hair dressing using cold waves are significant and cannot be frequently tolerated by most modern women. There is, therefore, a tendency toward a do-it-yourself approach in which the cold wave is effected at home.

There are numerous products allowing cold waves to be done at home or intended for that purpose. By and large these are relatively complex and expensive.

They include solid plastic curlers which, because of their relatively high weight and the large number of curlers which are required for an effective cold wave, frequently up to 50, create problems in handling.

There are hollow two-part curlers with holes making the curlers significantly lighter but substantially more costly since they require the fabrication of the two halves in the injection molding process separately and the cementing of the two halves together subsequently. In many cases these two-part curlers are also unsatisfactory.

OBJECTS OF THE INVENTION

It is, therefore, the principal object of the present invention to provide an improved hair curler whereby drawbacks of earlier hair curlers, especially for cold waving, is obviated.

Another object of this invention is to provide an improved hair curler, particularly convenient for use by a woman in a do-it-yourself home application of a cold wave, which can be easily handled and can ensure thorough penetration of the cold waving solution into the hair wound on the body of the curler.

Still another object of this invention is to provide a hair curler which is free from the drawbacks of prior art hair curlers both with respect to the construction and use, and can be relatively inexpensive.

SUMMARY OF THE INVENTION

These objects are achieved, in accordance with the present invention in a hair curler having a tubular body intermediate its ends which is composed of a grid.

A hair curler of this construction has the following advantages:

1. It is extremely light.
2. It is completely air and liquid permeable, at least at those regions at which the lock of hair is wound on the curler body.
3. It ensures a thorough penetration of the bundle of hair wound on the body by the treatment liquid.
4. It does not allow the accumulation of waving or fixing liquids or residues therefrom.
5. The lock-winding or curling technique is significantly simplified.

According to the invention, therefore, a hair curler for permanent waving, e.g. cold waving, can comprise:

a curler body formed with an intermediate region in the form of a liquid-permeable elongated cylindrical grid forming a tube, a first end member at one end of the body closing the tube at the one end, and a second end member at an opposite end of the body formed with an axial opening communicating with the tube and through which a hair-treatment medium can be fed to the tube; and a clamp member engageable across a lock of hair wound on the grid and attached to the body.

That tube can, according to the invention, be formed with circumferentially continuous stabilizing rings forming part of the grid structure. The end members are preferably both provided with peripheral grooves, e.g. milling facilitating gripping of the end members.

Advantageously, the first end member has a ball-shaped formation adapted to receive the eye of a clamping band, especially an elastic clamping band, forming the clamp member and alternatively engageable by a clamping stirrup which can pivot and swivel on that ball member.

The opening in the open end of the second member can correspond in diameter to an inner diameter of the tube. The second end member, moreover, can have a diameter greater than the diameter of the grid and can be formed with a multiplicity of notches for selectively engaging the clamping band or the clamping stirrup. These notches may impart a crown configuration to the end member and the inner diameter of the crown can be greater than an inner diameter of the tube.

According to a feature of the invention, the tube can be at least partly covered by a band of high liquid permeability having outwardly extending hair-engaging formations (see the commonly-owned copending application Ser. No. 08/138,635 filed 15 Oct. 1993), these formations being nylon hooks or loops as in Velcro or mushroom-shaped projections.

The grid can be closed peripherally toward opposite axial ends of the tube and can contain at least a partial filing of a bibulous material capable of taking up the solution to be applied to the hair.

The hair curler can have a conical configuration at the opening to fit a spray container whose nozzle can form-fittingly engage in the opening for feeding a wetting agent, waving agent, or hair-dressing agent to the tube.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
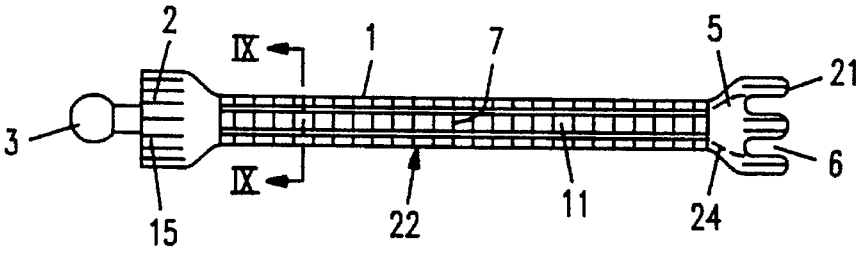
FIG. 1 is a side elevational view of a first embodiment of the invention.
Figure 2:
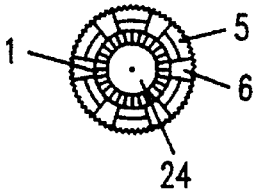
FIG. 2 is an end view seen in the direction of the second end member of this first embodiment.
Figure 9:
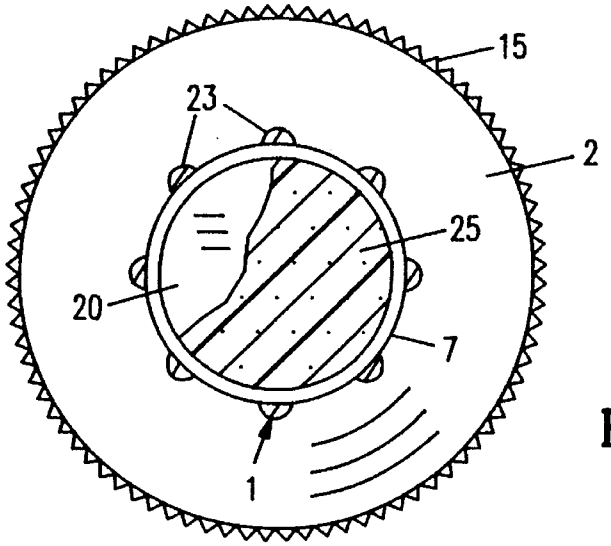
FIG. 9 is a cross sectional view taken along the line IX—IX of FIG. 1 but drawn to a larger scale.

As can be seen from FIGS. 1, 2 and 9, a hair curler according to the invention can comprise an injection-molded body 1 of a synthetic resin material, preferably polystyrene or polypropylene, which can have external dimensions (length and diameter) conforming to the usual standards and is completely cylindrical internally.

One end of the tubular body 1 is closed by an end member 2 molded unitarily with the body and the end wall of the tubular portion is shown at 20 in FIG. 9.

This end member 2 is of larger diameter than the intermediate portion of the body 1 and is provided with a fastening device 3 in the form of a pin with a ball-shaped head as represented at 3 which can be engaged by a clamping band.

The other end (second end member) of the tubular body 1 is a plastic part 5 of larger diameter and is completely open axially having notches 6 along the outer periphery to form a crown. The notches define fingers 21 between them which can be engaged by the other end of the elastic band 4 or by a stirrup 14 to be described in greater detail below.

The wall of the intermediate portion 22 of the body 1 is a large mesh grid with a multiplicity of openings through which liquid and air can pass unhindered. The rectangular, especially square, grid openings 11 can have a width and height of 1 to 7 mm, preferably 1.5 to 3 mm. The grid is formed by circular stabilizing rings 7 connected by axially-extending ribs 23 (FIG. 9). The stabilizing rings 7 ensure the requisite static strength.

Both end members of greater diameter than the intermediate portion 22 are formed with closely-spaced grooves 15, i.e. milling, to improve the manipulatability of the curler.

Figure 3:
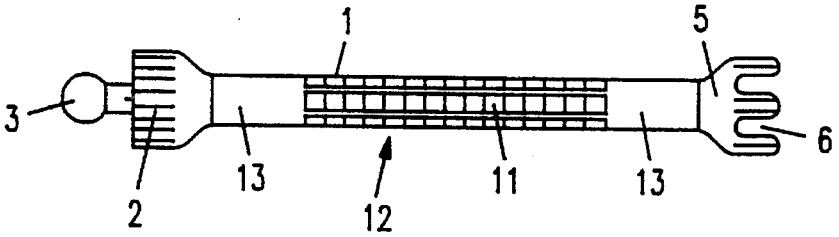
FIG. 3 is a side elevational view of a second embodiment having a partially closed tubular body.

The opening 11 can have other shapes, e.g. round or oval. The grid need not extend the full length of the intermediate portion 22. Rather, as shown in FIG. 3, the tubular intermediate portion 12 may have end regions 13 which are peripherally closed and thus unpermeable.

Figure 8:
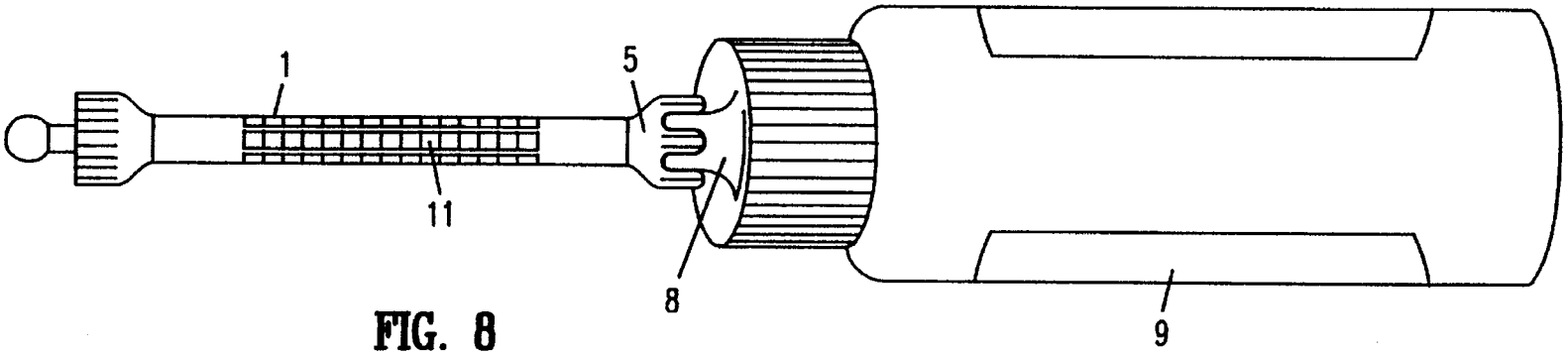
FIG. 8 is an elevational view of the embodiment of FIG. 3 being fed with a spray container of a waving agent, e.g. a fixer.

The opening 24 in the second end member 5 can be conical to mate with an outlet nozzle 8 of a spray container 9 (FIG. 8) which enables liquids, aerosol foams, lotions or the like to be forced into the curler and out through the grid thereof to thoroughly permeate a lock of hair wound on the intermediate portion 12, 22 of the curler. This ensures, together with external wetting, thorough penetration of all of the layers of the hair in a uniform manner.

Figure 7A:
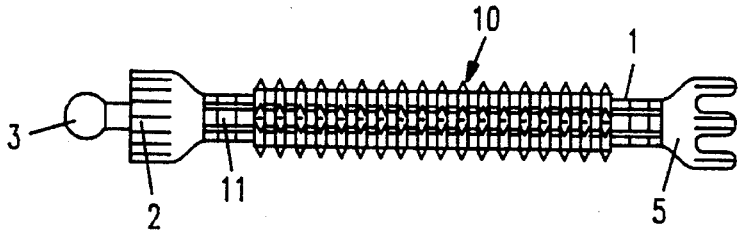
FIG. 7*a*–7*c* are is a side elevational views embodiments provided with a high permeability sheath of hook, loop, or mushroom shaped projection material to facilitate gripping of the hair.
Figure 7B:
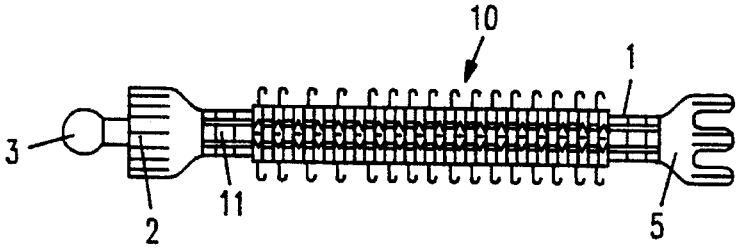
Figure 7C:
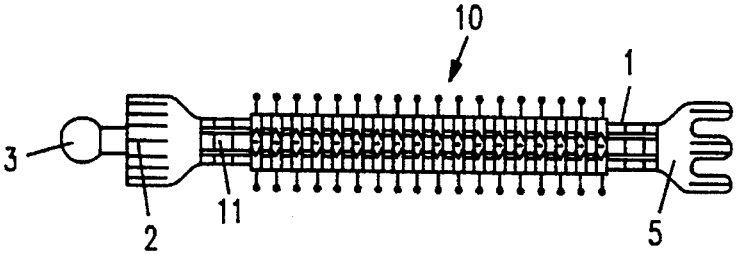

As can be seen from FIG. 7*a*–7*c* the intermediate portion 22 of the curler or hair roller can be formed with a sheath or band 10 of high permeability to air and liquid and provided with hair-engaging formations such as hooks and loops as described in the aforementioned application so that the initial engagement of the hair by the curler is facilitated. Alternatively, mushroom-shaped projection can be used as the hair engaging formations.

As can be seen at 25 in FIG. 9 a bibulous material can completely or partly fill the tube to absorb the liquid which is forced therethrough outwardly into the hair.

Figure 4:
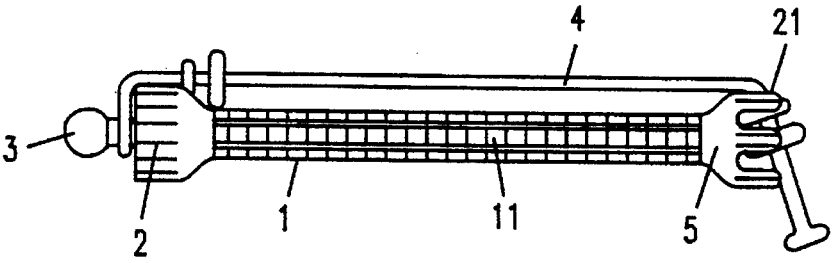
FIG. 4 is a side elevational view of the first embodiment provided with clamping band.
Figure 5:
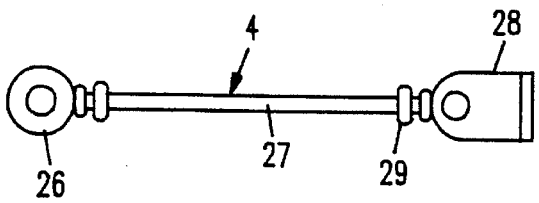
FIG. 5 is an elevational view of the clamping band.
Figure 6:
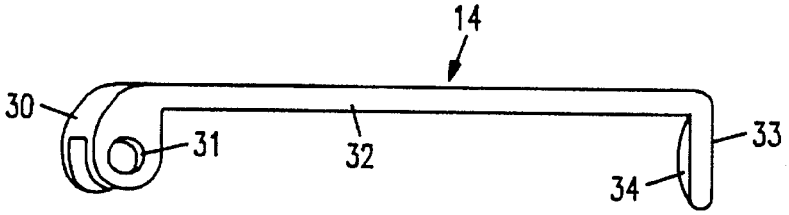
FIG. 6 is a perspective view of the clamping stirrup which can be substituted for the clamping band.

As can be seen from FIG. 5, the elastic band 4 has an eye 26 at one end engageable with the pin 3, a shank 27 and, at the opposite end, a tab 28 engageable by the fingers of the user. A shoulder 29 dimensioned so as to be incapable of passing broad side through the notches 6, allow the shoulder to lodge against the fingers 21 as is apparent form FIG. 4 when the band is stretched across a lock of hair rolled onto the curler.

The stirrup 14 is provided at one end with a fork 30, the parts of which can straddle the ball of pin 3 and have holes or recesses 31 forming a pivot on this ball. At the opposite end of the shank 32 of the stirrup 14, a lug 33 is provided with a convex indexing formation 34 engageable in the crown of fingers 21 when the stirrup is clamped over a lock of hair wound on the curler.

I claim:

1. A hair curler comprising:

a curler body formed with an intermediate region in the form of a liquid-permeable elongated cylindrical mesh grid having circular stabilizing rings connected by axially-extending ribs forming a tube, a first end member at one end of said body closing said tube at said one end, and a second end member at an opposite end of said body in one piece with said tube and being provided with an axial opening communicating with an inner diameter of said tube and a multiplicity of notches along the outer periphery defining fingers between them to form a crown defining a connector to engage an adaptor for the supply of hair treatment fluids to be fed to said tube and to form clamping means for selectively engaging a clamp member; and a clamping band or clamping stirrup forming said clamp member engageable across a lock of hair wound on said grid and attached to said body.

2. The hair curler defined in claim 1 wherein said end members are both provided with peripheral grooves for facilitating gripping of the end members.

3. The hair curler defined in claim 1 wherein said first end member has a ball-shaped formation adapted to receive an eye of said clamping band and engageable by a clamping stirrup.

4. The hair curler defined in claim 1 wherein said crown is formed with an inner diameter greater than that of said tube and said clamp member is provided with one end being engageable with said first.

5. The hair curler defined in claim 1 wherein said tube is at least partly covered by a band of high liquid permeability having outwardly extending hair-engaging formations.

6. The hair curler defined in claim 5 wherein said formations are nylon hooks.

7. The hair curler defined in claim 5 wherein said formations are nylon loops.

8. The hair curler defined in claim 5 wherein said formations are mushroom-shaped projections.

9. The hair curler defined in claim 1 wherein said grid is closed peripherally toward opposite axial ends thereof.

10. The hair curler defined in claim 1 wherein said grid contains at least a partial filling of a bibulous material.

11. The hair curler defined in claim 1 wherein said opening has a conical configuration for receiving a supply container having a nozzle formfittingly engaging in said opening-for feeding a fluid to said tube.

12. The hair curler defined in claim 1 wherein said first end member has a ball-shaped formation adapted to receive an eye.

* * * * *

UNITED STATES PATENT AND TRADEMARK OFFICE

CERTIFICATE OF CORRECTION

PATENT NO. : 5,558,107

DATED : September 24, 1996

INVENTOR(S) : KIM

It is certified that error appears in the above-indentified patent and that said Letters Patent is hereby corrected as shown below:

On the title page, item [75], inventor's name should read:
Hyeong S. (Morin) Kim Column 3, line 41, cancel "is a".
Column 3, line 41, after "views" insert --of--.

Signed and Sealed this

Seventeenth Day of December, 1996

*Attest:*

Bruce Lehman

BRUCE LEHMAN

*Attesting Officer*

*Commissioner of Patents and Trademarks*